US008746408B2

(12) United States Patent
Albertson et al.

(10) Patent No.: US 8,746,408 B2
(45) Date of Patent: Jun. 10, 2014

(54) ENGINE OIL CHANGE DETECTION SYSTEMS AND METHODS

(75) Inventors: William C. Albertson, Clinton Township, MI (US); David R. Staley, Flushing, MI (US); Mike M McDonald, Macomb, MI (US); Bryan K. Pryor, Pontiac, MI (US)

(73) Assignee: GM Global Technology Operations LLC

( * ) Notice: Subject to any disclaimer, the term of this patent is extended or adjusted under 35 U.S.C. 154(b) by 2101 days.

(21) Appl. No.: 11/514,673

(22) Filed: Sep. 1, 2006

(65) Prior Publication Data

US 2008/0093172 A1 Apr. 24, 2008

(51) Int. Cl.
*F01M 11/10* (2006.01)
*G06F 17/00* (2006.01)

(52) U.S. Cl.
USPC ..... 184/6.4; 701/29

(58) Field of Classification Search
USPC ..... 184/6.4; 701/29
See application file for complete search history.

(56) References Cited

U.S. PATENT DOCUMENTS

| | | | | |
|---|---|---|---|---|
| 3,656,140 | A * | 4/1972 | Gruber et al. | 340/526 |
| 4,168,693 | A * | 9/1979 | Harrison | 123/196 S |
| 5,381,874 | A * | 1/1995 | Hadank et al. | 184/6.4 |
| 5,442,671 | A * | 8/1995 | Wollschlager et al. | 377/55 |
| 5,808,471 | A * | 9/1998 | Rooke et al. | 324/546 |
| 5,823,295 | A * | 10/1998 | Griffith et al. | 184/6.4 |
| 5,853,068 | A * | 12/1998 | Dixon et al. | 184/1.5 |
| 6,977,583 | B2 | 12/2005 | Gornick | |
| 7,030,580 | B2 * | 4/2006 | Hoff | 318/141 |
| 7,178,499 | B2 * | 2/2007 | Wolf et al. | 123/196 S |
| 7,677,086 | B2 | 3/2010 | Albertson et al. | |
| 2005/0022784 | A1 * | 2/2005 | Wolf et al. | 123/397 |
| 2008/0282786 | A1 * | 11/2008 | Van Weelden et al. | 73/114.56 |

* cited by examiner

*Primary Examiner* — William E Dondero
*Assistant Examiner* — Robert T Reese

(57) ABSTRACT

An engine oil change detection control system is provided. The system includes an armature position module that monitors a solenoid armature position based on a position signal. A solenoid control module selectively generates a solenoid control signal and estimates a delay time based on the solenoid control signal and the armature position. An engine oil change detection module detects an engine oil change event based on the delay time.

16 Claims, 9 Drawing Sheets

ENGINE OIL CHANGE DETECTION SYSTEMS AND METHODS

FIELD

The present disclosure relates to engine control systems and methods.

BACKGROUND

The statements in this section merely provide background information related to the present disclosure and may not constitute prior art.

Motor oil is a type of liquid oil used for lubrication by various types of motors. In particular, internal combustion engines use motor oil to provide lubrication between mechanical components. The motor oil also serves as a cooling system to the engine. The motor oil dissipates heat generated by friction between the mechanical components.

Motor oil eventually becomes saturated with particulates. The motor oil should be changed at regular intervals to prevent damage to the engine. Most car manufacturers specify the appropriate interval to change the oil. Some drivers neglect to change their engine oil on regular intervals, if at all. Therefore, it is beneficial for car manufactures and purchasers to know if and when the oil has been changed.

Current methods of detecting an oil change require user interaction. For example, the engine control system may monitor a pedal position while the engine is off to detect an oil change event. For example, three consecutive pedal pumps by the driver indicates to the engine control system that the engine oil has been changed. Once the ignition is turned on, the engine control system turns off the change engine oil light. Some drivers reset the change engine oil light without physically changing the oil. Therefore, the system may not be reliable.

SUMMARY

Accordingly, an engine oil change detection control system is provided. The system includes an armature position module that monitors a solenoid armature position based on a position signal. A solenoid control module selectively generates a solenoid control signal and estimates a delay time based on the solenoid control signal and the armature position. An engine oil change detection module detects an engine oil change event based on the delay time.

In other features, an engine oil change detection system for an engine is provided. The system includes a solenoid disposed within an engine oil sump wherein the solenoid includes an armature. A passage routes to the armature including an orifice to allow fluids to flow through the passage. A control module energizes and de-energizes the solenoid, monitors a position of the armature based on the energizing and the de-energizing of the solenoid, estimates a delay time based on the position, and detects an engine oil change event based on the delay time.

In still other features, an oil change detection system for an engine is provided. The system includes an engine oil sump. A switch is disposed within the engine oil sump. A removable drain plug including a magnetized material is disposed within the engine oil sump. A capacitor electrically connects with the switch. The switch discharges the capacitor based on a position of the removable drain plug including the magnetized material. A control module detects an engine oil change event based on a voltage of the capacitor.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 5A:
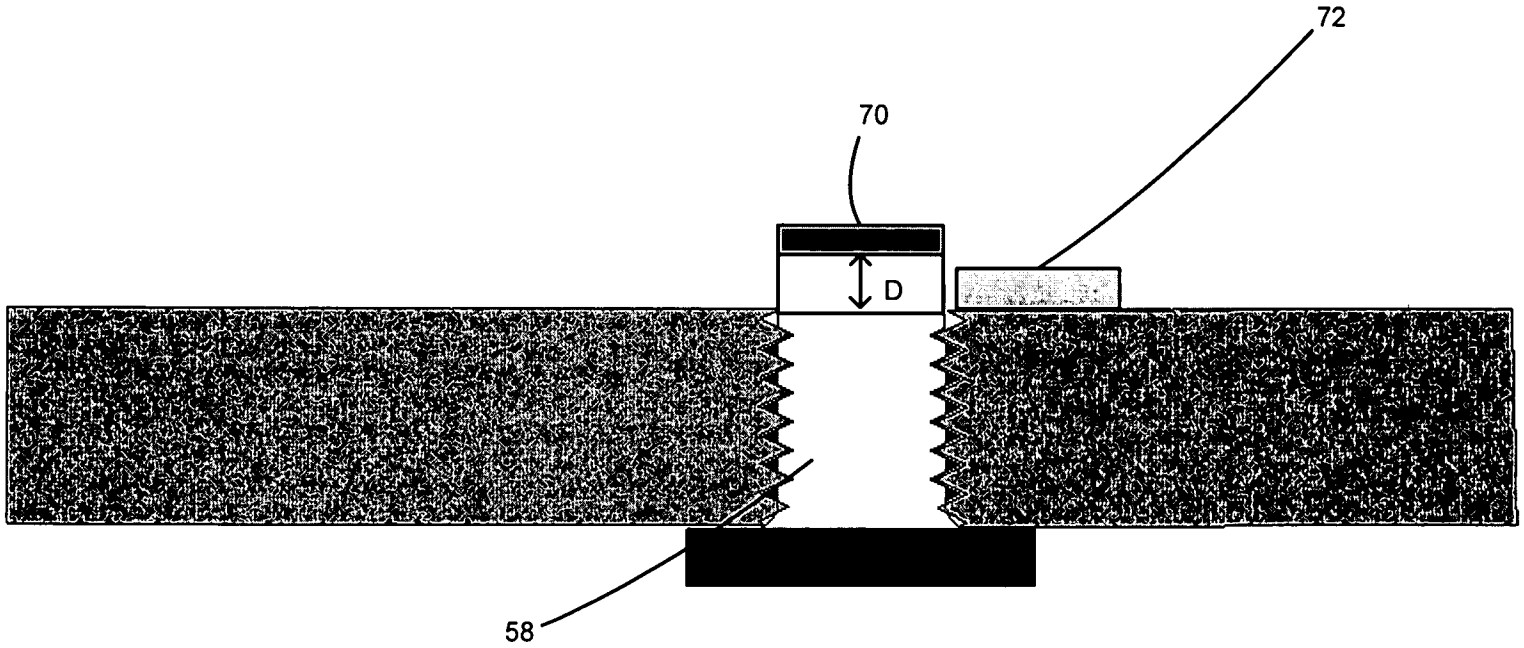

FIG. 5*a* is a cross-sectional view of another embodiment of an engine oil change detection system including a magnetic switch disposed within an engine oil sump.

Figure 5B:
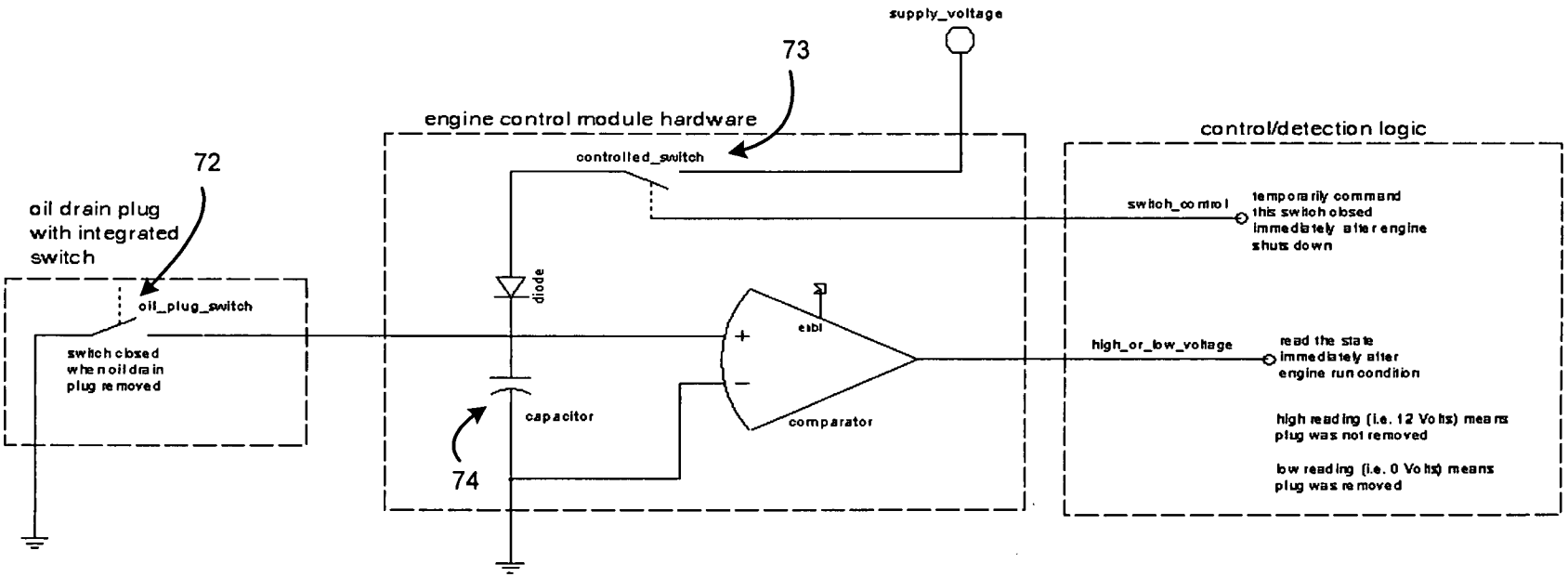

FIG. 5*b* is an exemplary circuit for the engine oil detection system shown in FIG. 5*a*.

Figure 6:
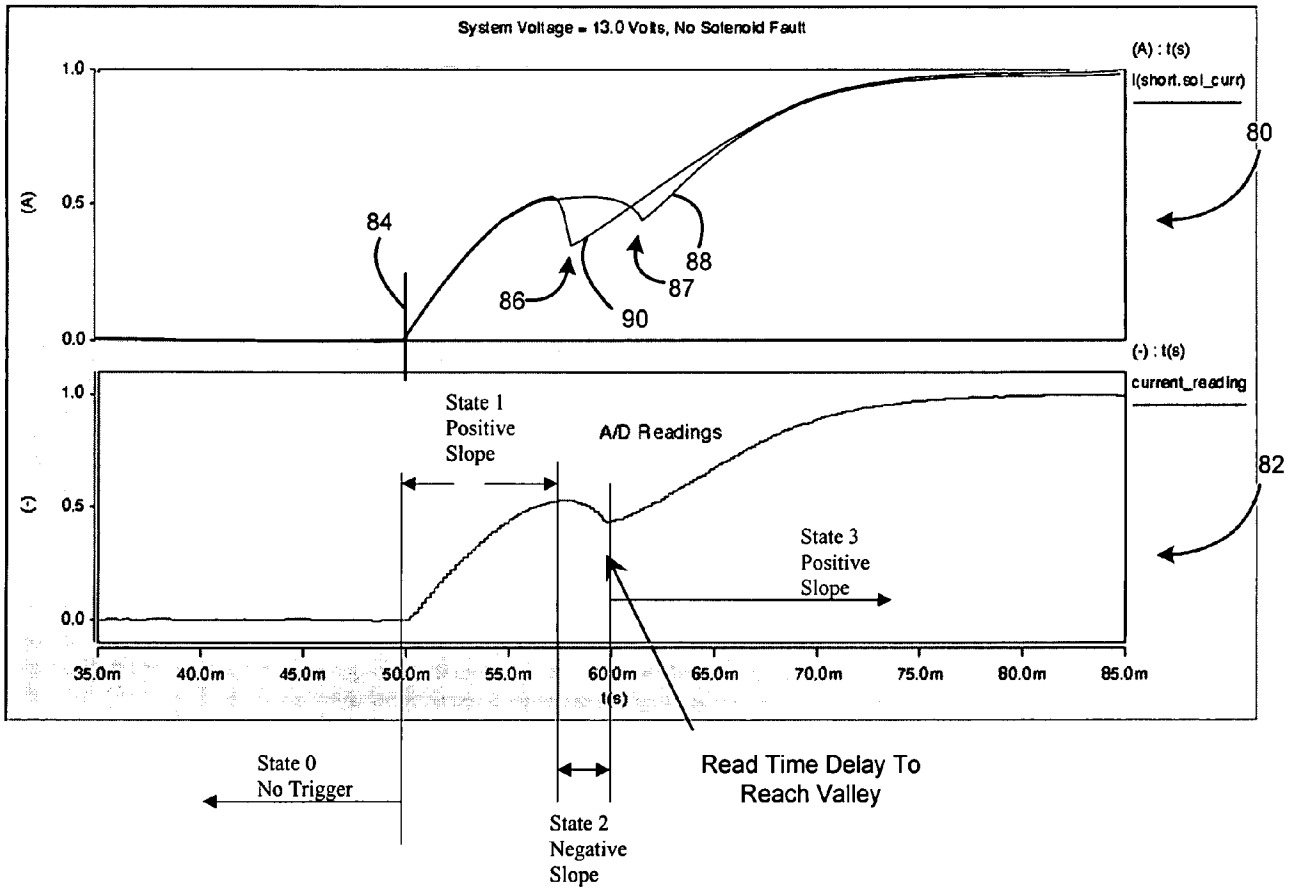

FIG. 6 is a graphical representation of solenoid current.

Figure 7:
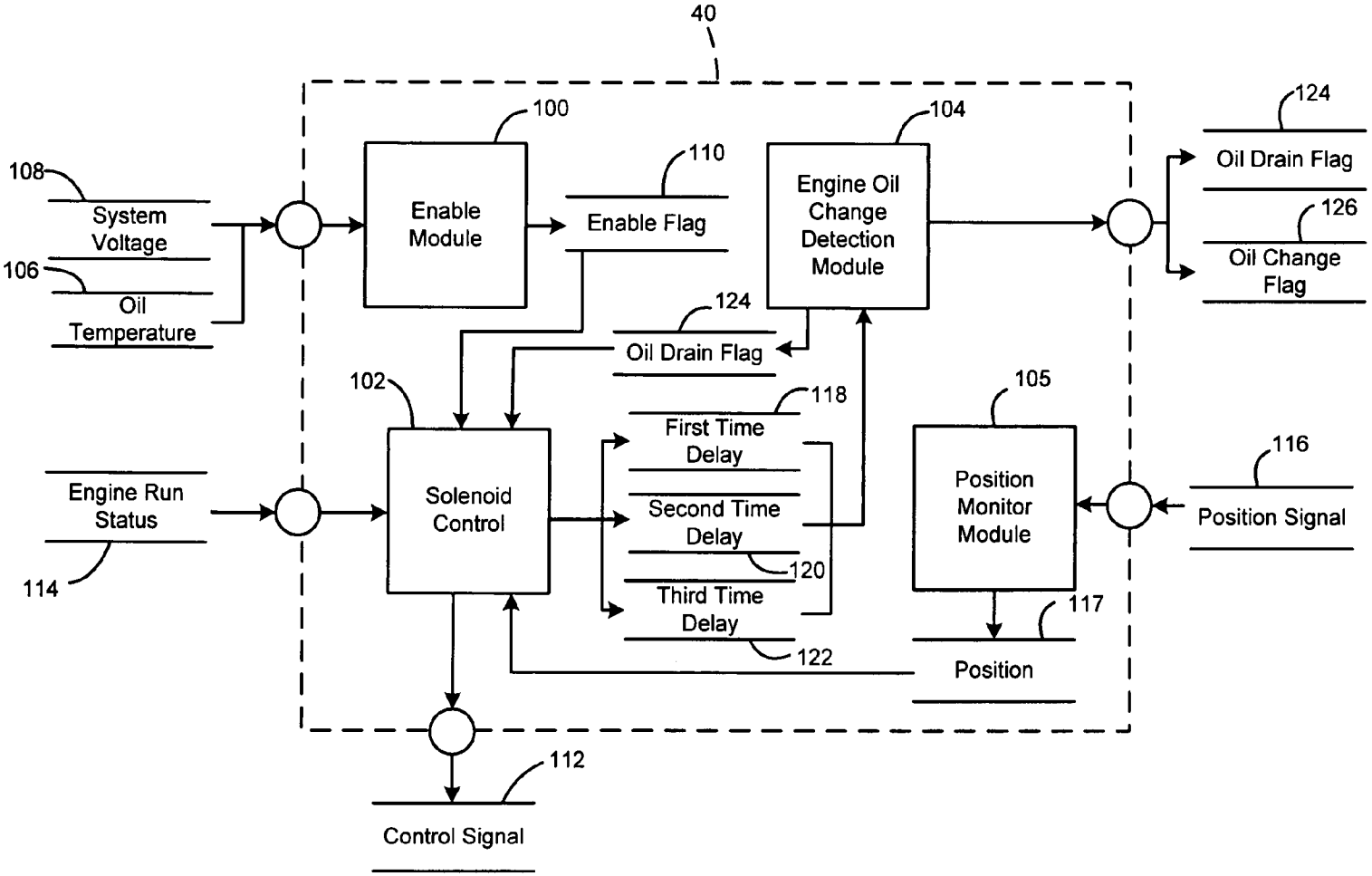

FIG. 7 is a dataflow diagram illustrating an engine oil change detection system.

Figure 8:
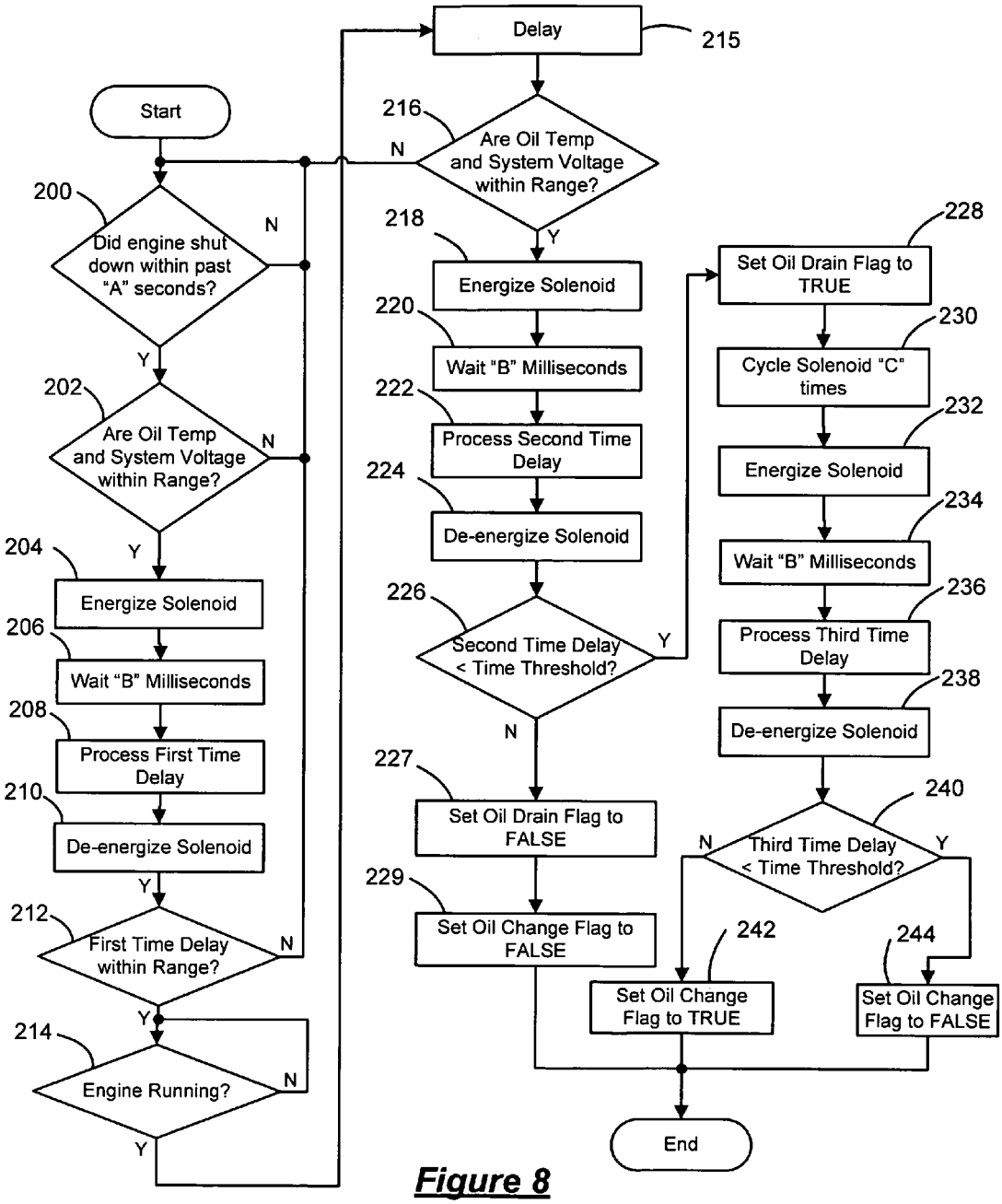

FIG. 8 is a flowchart illustrating an engine oil detection method.

DETAILED DESCRIPTION

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that executes one or more software or firmware programs, a combinational logic circuit, and/or other suitable components that provide the described functionality.

Figure 1:
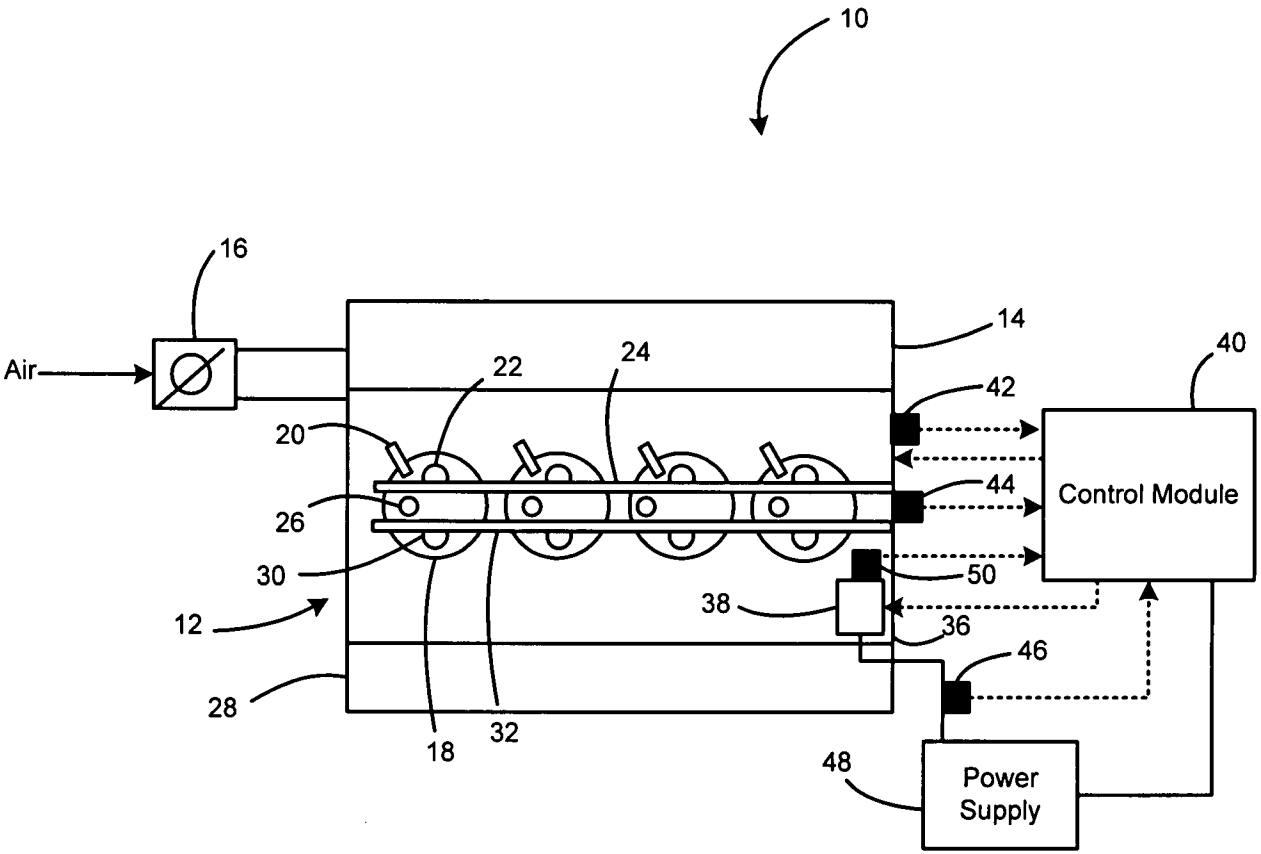
FIG. 1 is a functional block diagram illustrating an engine system.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although four cylinders 18 are illustrated, it can be appreciated that the engine 12 can have a plurality of cylinders including, but not limited to, 2, 3, 5, 6, 8, 10, 12 and 16 cylinders. Although the cylinders 18 are shown to be in an inline configuration, it can be appreciated that the cylinders 18 can alternatively be in a V-shaped configuration.

A fuel injector 20 injects fuel that is combined with the air as it is drawn into the cylinder 18 through an intake port. An intake valve 22 selectively opens and closes to enable the air/fuel mixture to enter the cylinder 18. The intake valve position is regulated by an intake camshaft 24. A piston (not shown) compresses the air/fuel mixture within the cylinder 18. A spark plug 26 initiates combustion of the air/fuel mixture, driving the piston in the cylinder 18. The piston drives a crankshaft (not shown) to produce drive torque. Combustion exhaust within the cylinder 18 is forced out through an exhaust manifold 28 when an exhaust valve 30 is in an open position. The exhaust valve position is regulated by an exhaust camshaft 32. The exhaust is treated in an exhaust system.

An engine oil sump 36 couples to the engine 12 and serves as a reservoir for engine oil. An engine oil pump (not shown) circulates oil through passages of the engine 12 to provide lubrication as well as to cool the engine 12. A solenoid 38 is disposed within the engine oil sump 36. Alternatively, a magnetic switch 72 shown in FIG. 5*a* is disposed within the engine oil sump 36. A control module 40 controls the solenoid 38 or reads the switch 72 (FIG. 5*a*) and detects a change of engine oil. The control module 40 detects the change based on a response time of the solenoid 38 or a state of the switch 72 (FIG. 5*a*) and one or more sensory inputs.

More particularly, an oil temperature sensor 42, or equivalent algorithm, generates an oil temperature signal based on a temperature of oil within the engine 12. An engine speed sensor 44 generates an engine run signal based on an operational state of the engine 12. A voltage sensor 46 senses a voltage of the engine system 10 provided by a power source 48. A solenoid current sensor 50 senses the current of the solenoid and generates a solenoid current signal. Alternatively, a hall effect sensor senses a changing magnetic flux of the solenoid 38 or a position sensor senses a position of an armature 54 (FIG. 2) of the solenoid 38 as will be discussed in further detail below. The control module 40 receives the above mentioned signals and detects an engine oil change as will be discussed in more detail below.

Figure 2:
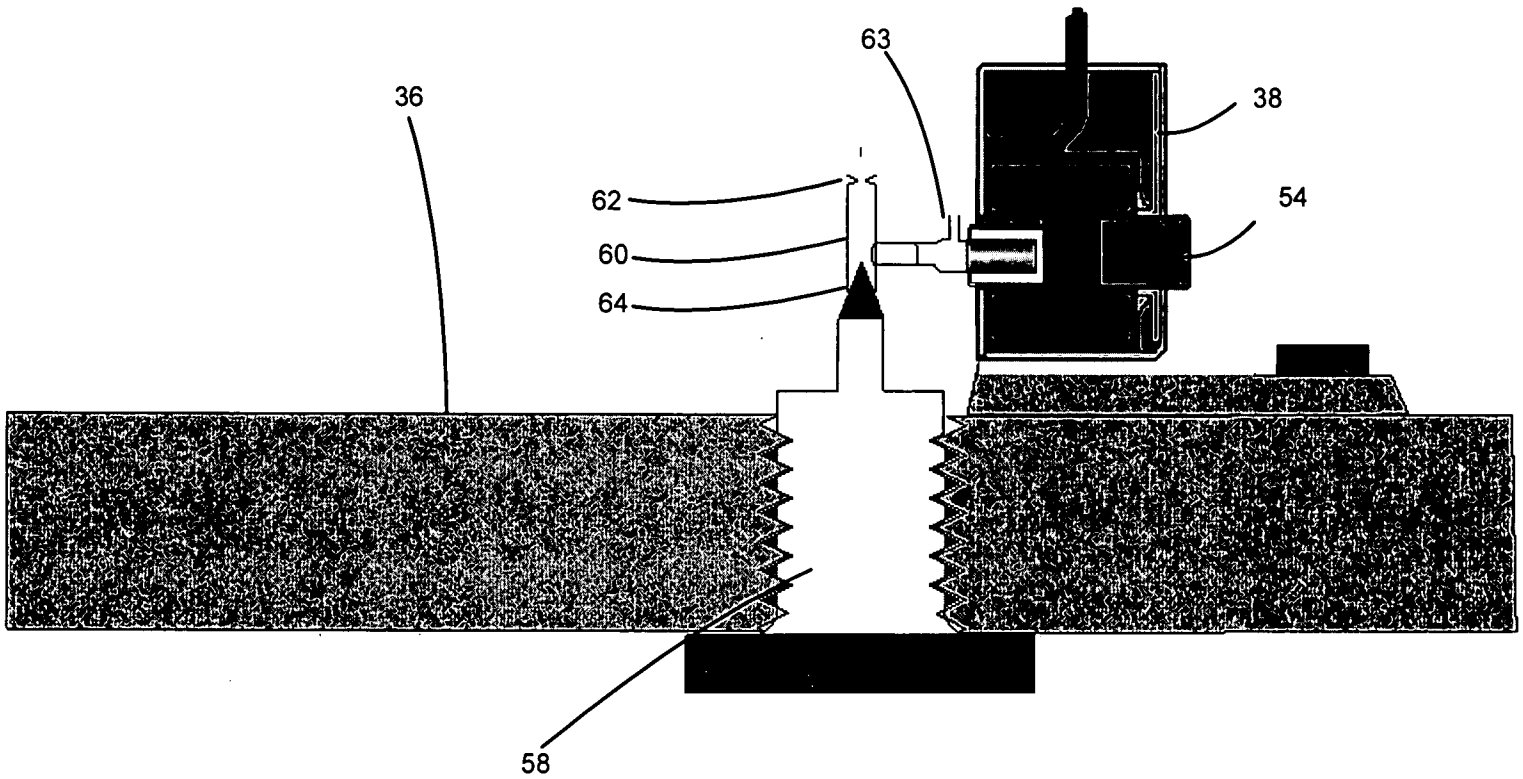
FIG. 2 is a cross-sectional view of an embodiment engine oil change detection system including a solenoid and an orifice disposed within an engine oil sump.

Referring to FIG. 2, a cross-sectional view of an exemplary solenoid 38 having a fluid sensitive damper is shown. The solenoid 38 generally includes an electromagnetic coil (not shown) and an armature 54 that is disposed coaxially within the coil. The armature 54 is biased to a first position relative to the coil by a biasing force. The biasing force can be imparted by a biasing member, such as a spring (not shown). The solenoid 38 is energized by supplying current to the coil, which induces magnetic force along the coil axis. The magnetic force induces linear movement of the armature 54 to a second position. The solenoid 38 is disposed within proximity of a removable drain plug 58. A passage 60 is routed to the face of the armature 54. Oil flows through the passage 60 to provide a resistance that lengthens the response time of the armature 54. When removed, the drain plug 58 allows engine oil to flow out of the engine oil sump 36 and passage 60. The sensor 50 (FIG. 1) senses the movement of the armature 54 based on one of a magnetic flux, solenoid current, and armature position. For ease of the discussion, the remainder of the disclosure will be discussed in the context of the solenoid current. As can be appreciated, the remainder of the disclosure is equally applicable to other methods of sensing the armature movement.

By altering the presence of oil in the passage 60, the solenoid 38 is able to react in a respective fashion. The solenoid current signal defines the fluid characteristics in the passage 60. In various embodiments, the passage 60 includes a conduit that is turned vertically with an orifice 62 included at the end opposite of the armature 54. Near the face of the solenoid 38 is a vent port 63 that is normally closed off when the solenoid 38 is in the off position. A second vent port 64 is sealed off by the drain plug 58 when inserted. Removal of the drain plug 58 drains oil from the fluid passage 60. Air then fills the passage 60. After the oil has been completely drained, the engine oil sump 36 is filled with new oil. In doing so, an air bubble is trapped in the fluid passage 60. With the solenoid armature 54 now exposed to air, the solenoid current signal is measurably different due to the minimal flow-resistance of the air. Repeated cycling of the valve will allow the air to be purged, filling the passage with oil, thus again changing the response of the solenoid. From the change in response time, a change in engine oil can be inferred.

Figure 3:
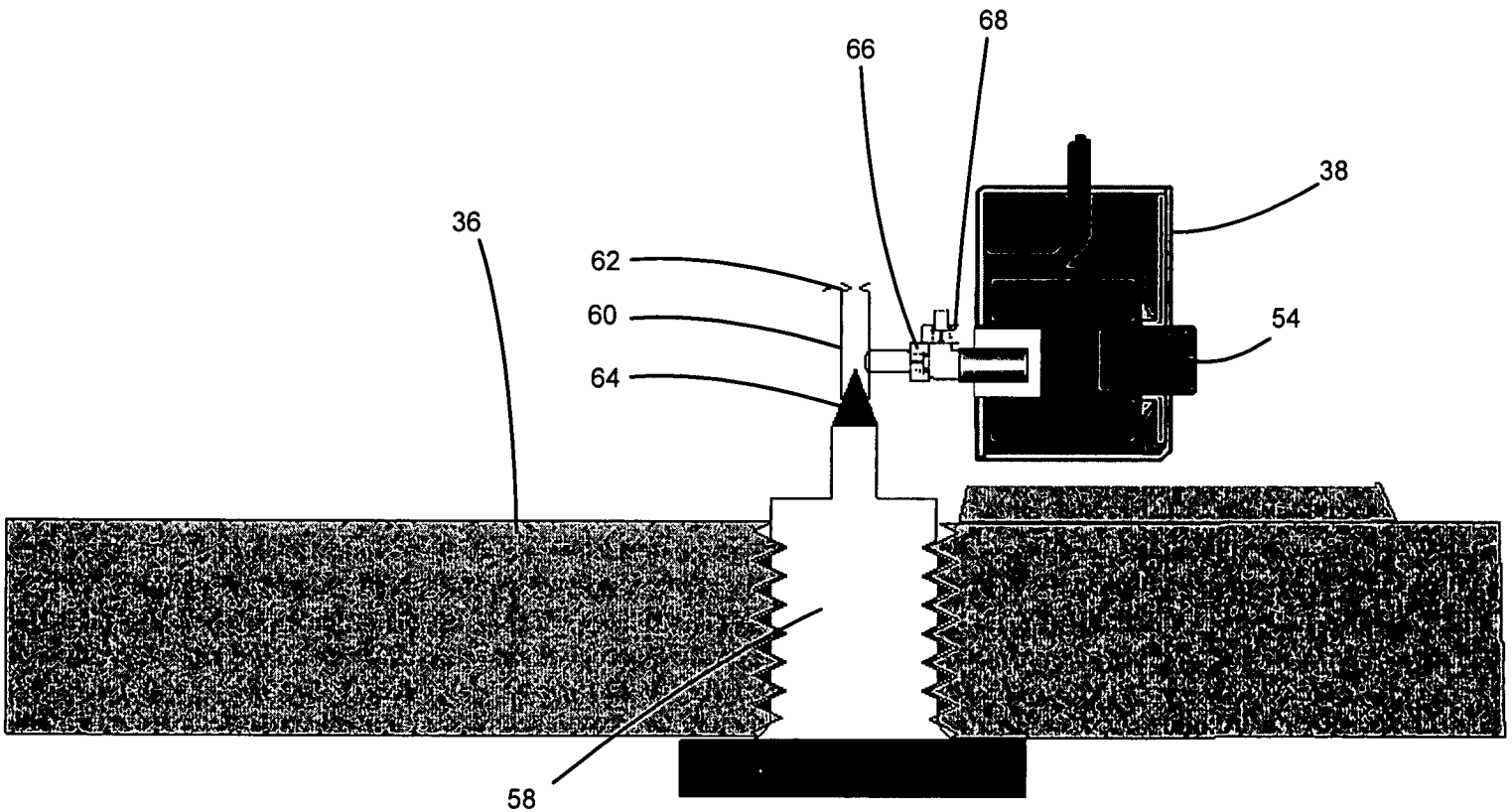
FIG. 3 is a cross-sectional view of another embodiment of an engine oil change detection system including a solenoid, an orifice, and two check valves disposed within an engine oil sump.

FIG. 3 is a cross-sectional view of various other embodiments of the fluid passage whereby two spring loaded check valves 66, 68 are installed at the face of the solenoid 38. The arrangement of the valves 66,68 is such that by cycling the solenoid 38, the armature 54 serves as a positive displacement pump that physically pushes the trapped air bubble out of the fluid passage 60. Otherwise, the engine oil detection system behaves as previously described. Utilizing the valves may provide for a quicker response. It can be appreciated that reed valves can similarly be implemented in place of the check valves.

Figure 4:
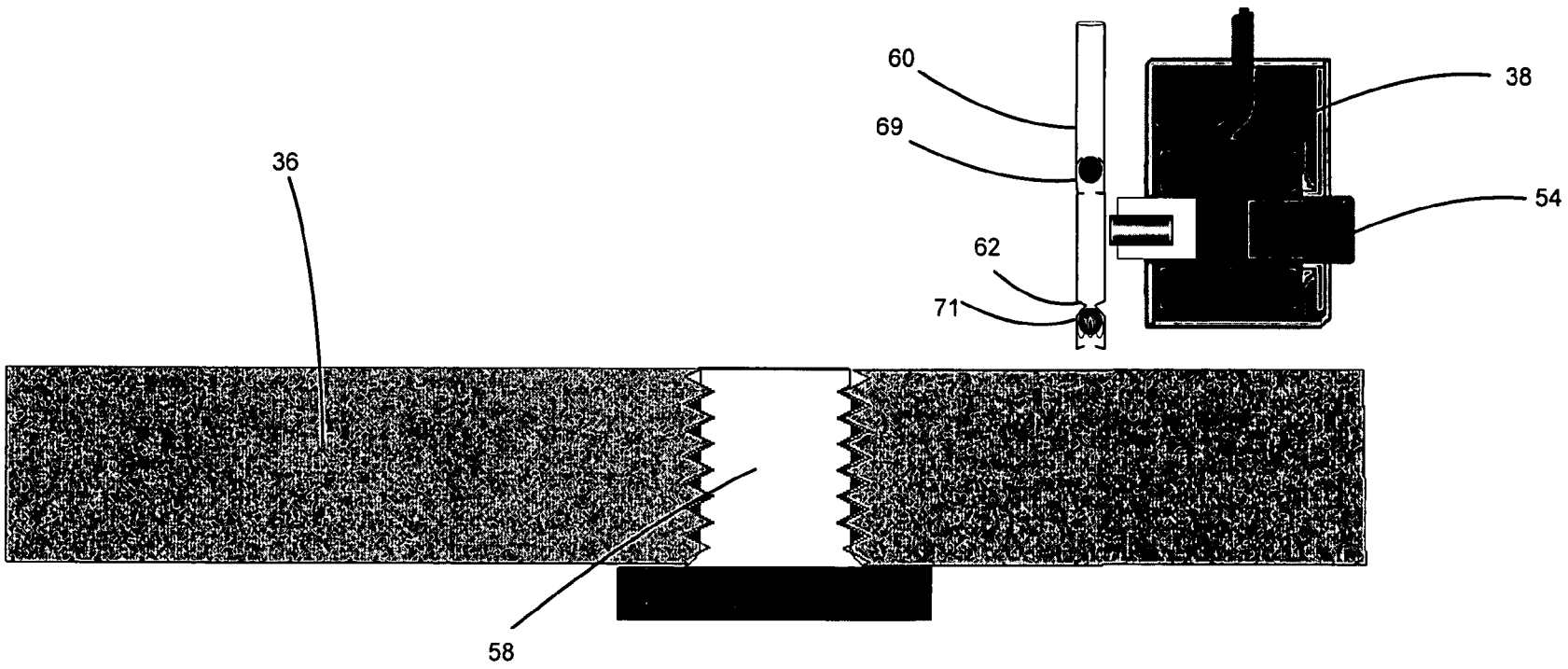
FIG. 4 is a cross-sectional view of another embodiment of an engine oil change detection system including a solenoid, an orifice, and buoyant check balls.

FIG. 4 is a cross sectional view of various embodiments of an engine oil detection system whereby two buoyant check balls 69, 71 are disposed within the passage 60. The location of the passage 60 is such that the drainage of the passage 60 does not rely on the position of the drain plug 58. As shown, two buoyant check balls 69, 71 act to seal and unseal the passage based on the flow of fluids.

Referring now to FIGS. 5*a* and 5*b*, a cross-sectional view of a switch 72 disposed within the engine oil sump 36 is shown. As can be appreciated, a magnetic switch 72 can be disposed within the engine oil sump 36 in place of the solenoid 38 of FIGS. 2 and 3. The drain plug 58 includes a magnet 70 located a distance "D" from the switch 72 so as to not trigger the switch 72 when in place. A change in engine oil is detected based on a change in voltage of a capacitor 74 shown in FIG. 5*b*. FIG. 5*b* is a schematic illustrating an engine oil detection system including a switch 72 in more detail. A supply voltage will stay active for many minutes after the engine 12 is shut off. Immediately after shutting the engine 12 down, a second controlled switch 73 is commanded closed for a specified amount of time (e.g. 1 second) thus, charging the capacitor 74. The controlled switch 73 is then commanded open.

If removed, the magnet 70 in the drain plug 58 will cause the first switch 72 disposed within the engine oil sump 36 to close thus, discharging the capacitor 74 to the grounded engine oil sump 36. The capacitor 74 will be discharged to zero Volts. Immediately after the engine starts up, the voltage on the capacitor 74 is read. If it is near 0.0 Volts, the drain plug 58 was removed and it is inferred that the engine oil was changed.

Referring now to FIG. 6 and with continued reference to FIGS. 2, 3, an 4, a graphical representation of exemplary current flowing through the solenoid 38 is shown. The top graph 80 corresponds to actual current signals flowing through the solenoid 38. The bottom graph 82 corresponds to digital current readings. In the top graph, a solenoid current signal generated after no oil drainage is shown at 88. A solenoid current signal generated after oil drainage is shown at 90. In both graphs 80 and 82, a trigger signal 84 indicating the start of energizing the solenoid 38 occurs at approximately 50 ms and "valleys" shown generally at 86,87 exists at approximately 60 ms. The "valleys" 86,87 in the current readings corresponds to the armature 54 of the solenoid 38 hitting a mechanical stop. The time delay is the difference in time between the trigger signal 84 and the "valleys" 86,87 of the current readings In the bottom graph 82, state 0 describes the state of the solenoid 38 before the trigger signal 84 is commanded, state 1 describes the state of increasing solenoid current, state 2 describes decreasing solenoid current, and state 3 describes increasing solenoid current after the armature 54 of the solenoid 38 has hit the mechanical stop. The time delay is the time elapsed between the state 0 to state 1 transition and the state 2 to state 3 transition.

The time of the state 0 to state 1 transition is the time that the trigger signal 84 is activated. However, the time for the remaining transitions is calculated by inspection of the current signal. In state 1, the current signal increases and has a positive slope. In state 2, the current signal decreases and has a negative slope. The state 1 to state 2 transition is when the current slope changes from positive to negative. Since state 3 has an increasing slope, the state 2 to state 3 transition is determined by the time at which the current slope changes from negative to positive.

As is commonly known, the derivative of a function represents the slope of the function. In a discrete domain, an adequate approximation of the derivative of the solenoid current signal can be calculated in order to determine the slope. Several numerical methods may be employed to achieve this objective. The simplest is a two-point backward difference approximation of the derivative. The two-point backward difference approximation uses the following equation:

$$y' = \frac{y_n - y_{n-1}}{h}$$

where y' is the approximate derivative of the current signal, $y_n$ is the present sample of the current signal, $y_{n-1}$ is the previous sample of the current signal, and h is the time between samples of the current signal.

The two-point backward difference approximation of the derivative may be sensitive to signal noise. Approximations with a smaller degree of error can be calculated, but they generally use additional samples to achieve accuracy or use non-realtime processing. Therefore, it is preferable to calculate the derivative of a moving average of the current signal rather than the current signal directly. Although the moving average of the samples will help smooth out noise, it is still possible for slight increases and decreases in the derivative of the slope to prematurely indicate that the current signal has changed direction. Thus, it is preferable for a change in slope to persist for several consecutive samples before it is reported. If the state 2 to state 3 transition is not detected within a predetermined period, a maximum time (e.g., 50 ms) is reported as the response time of the solenoid 38.

Referring now to FIG. 7, a dataflow diagram illustrates various embodiments of an engine oil change detection control system that may be embedded within the control module 40. Various embodiments of engine oil change detection control systems according to the present disclosure may include any number of sub-modules embedded within the control module 40. The sub-modules shown may be combined and/or further partitioned to similarly detect a change in engine oil. Inputs to the engine oil change detection control system may be sensed from the engine system 10 (FIG. 1), received from other control modules (not shown), and/or determined by other sub-modules (not shown) within the control module 40. In various embodiments, the control module 40 of FIG. 7 includes an enable module 100, a solenoid control module 102, an engine oil change detection module 104, and a position monitor module 105.

The enable module 100 selectively enables the solenoid control module 102 to control the solenoid 38 (FIG. 1) based on enable parameters. Such enable parameters include, but are not limited to, engine oil temperature 106 and system voltage 108. For example, if the engine oil temperature 106 is within a predetermined oil temperature range and the system voltage 108 is within a predetermined voltage range, an enable flag 110 is set to TRUE. Otherwise, the enable flag 110 remains FALSE. The position monitor module 105 monitors a position signal 116 to determine an armature position 117. In various embodiments, the position signal 116 indicates solenoid current and the position 117 is determined as discussed above.

The solenoid control module 102 selectively commands a solenoid control signal 112 to energize and de-energize the solenoid 38 (FIG. 1) based on the enable flag 110 and an engine run status 114. For example, immediately after the engine run status 114 indicates that the engine 12 (FIG. 1) has shutdown, the solenoid control module 102 commands the solenoid 38 (FIG. 1) energized via the solenoid control signal 112. After commanding the solenoid 38 to be energized, the solenoid control module 102 measures a first time delay 118 based on the position 117 to verify proper operation of the solenoid 38 (FIG. 1). The solenoid 38 is then commanded to be de-energized. Once the engine run status 114 indicates the engine is running again, the solenoid control module 102 again commands the solenoid 38 (FIG. 1) to be energized. The solenoid control module 102 measures a second time delay 120 based on the position 117. The solenoid 38 is then commanded to be de-energized.

If the drain plug 58 (FIG. 2) was removed and the oil drained out of the engine oil sump 36 (FIG. 2), the second time delay 120 will be a small value compared to the case where the drain plug 58 (FIG. 2) was not removed. If the second time delay 120 is a small value, there is an air bubble in the passage 60 (FIG. 2). The solenoid control module 102 purges the air out of the passages 60 (FIG. 2) by cycling the solenoid control signal 112. After cycling the solenoid control signal 112 a predetermined number of times, the solenoid control module 102 commands the solenoid 38 (FIG. 1) energized and measures a third time delay 122 based on the position 117. A large value for the third time delay 122 indicates that the engine oil sump 36 (FIG. 2) was refilled with oil and therefore an oil change has occurred.

The engine oil change detection module 104 detects an oil change and sets oil change indicator flags based on the first time delay 118, the second time delay 120, and the third time delay 122. If the first time delay 118 is normal (within a predetermined range), the engine oil change detection module 104 evaluates the second time delay 120. If the second time delay 120 is less than a predetermined time, then an oil drain flag 124 is set to TRUE. Otherwise, the oil drain flag 124 is set to FALSE. If the second time delay 120 is less than a predetermined time and the third time delay 122 is less than a predetermined threshold, an oil change flag 126 is set to FALSE. Otherwise, the oil change flag 126 is set to TRUE.

Referring now to FIG. 8, a flowchart illustrates various embodiments of an engine oil change detection method that may be performed by the control module 40. The method may be run periodically. At 200, the engine run status is evaluated. If the engine run status indicates that the engine has shutdown within a predetermined time period "A" at 200, the enable conditions are evaluated at 202. Otherwise, continues to evaluate the engine run status at 200. If the engine oil temperature is within a predetermined oil temperature range and the system voltage is within a predetermined voltage range at 202, a first time delay is measured at 204 to 210. Otherwise, control loops back to evaluate the engine run status at 200.

At 204, the solenoid is energized. A predetermined time period "B" elapses at 206 before processing the first time delay at 208. Once the first time delay is processed at 208, the solenoid is de-energized at 210. If the first time delay is within a time delay range, indicating a normal response at 212, control proceeds to wait until the engine run status indicates the engine is running at 214. Otherwise, control loops back and continues to evaluate the engine run status for the next shutdown event at 200. If the engine run status indicates the engine is running at 214, a delay occurs at 215 and enable conditions are evaluated at 216. If the engine oil temperature is within a predetermined oil temperature range and the system voltage is within a predetermined voltage range at 218, a second solenoid time delay is measured at 218 to 224. Otherwise, control loops back to evaluate the engine run status at 200. Alternatively (flow not shown), instead of providing a delay at 215, the enable conditions are continually monitored while the engine is running at 216. If the engine shuts down, control proceeds to evaluate engine run status at 200.

At 218, the solenoid is energized. A predetermined time period elapses at 220 before processing the second time delay at 222. Once the second time delay is processed at 222, the solenoid is de-energized at 224. If the second time delay is less than a predetermined time threshold, the oil drain flag is set to TRUE at 228. Otherwise, the oil drain flag is set to FALSE at 227 and the oil change flag is set to FALSE at 229. Once the oil drain flag is set to TRUE at 228, the solenoid is cycled a predetermined number of times C by energizing and de-energizing the solenoid. Once the solenoid has been cycled C times, a third time delay is measured at 232 to 238. If the third time delay is less than a predetermined time threshold, the oil change flag is set to FALSE. Otherwise, the oil change flag is set to TRUE. Thereafter, control proceeds to the end.

As can be appreciated, all comparisons discussed above can be implemented in various forms depending on the selected values for comparison. For example, a comparison of "greater than" may be implemented as "greater than or equal to" in various embodiments. Similarly, a comparison of "less than" may be implemented as "less than or equal to" in various embodiments. A comparison of "within a range" may be equivalently implemented as a comparison of "less than or equal to a maximum threshold" and "greater than or equal to a minimum threshold" in various embodiments.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, specification, and the following claims.

What is claimed is:

1. An engine oil change detection control system, comprising:

an armature position module that monitors a solenoid armature position based on a position signal;

a solenoid control module that selectively generates a solenoid control signal and estimates a delay time based on the solenoid control signal and the solenoid armature position; and an engine oil change detection module that detects an engine oil change event based on the delay time.

2. The system of claim 1 wherein the solenoid control module generates the solenoid control signal based on an engine run status.

3. The system of claim 2 wherein the solenoid control module estimates a first delay time after the engine run status indicates an engine shutdown event occurred and evaluates the first time delay time based on a first time range.

4. The system of claim 2 wherein the solenoid control module estimates a second time delay after the engine run status indicates an engine startup event occurred and estimates a third time delay when the second time delay is less than a time threshold.

5. The system of claim 4 wherein the solenoid control module cycles the solenoid control signal when the second time delay is less than the time threshold.

6. The system of claim 4 wherein the engine oil change detection module sets at least one of an oil drain status indicator and an oil change status indicator based on the second time delay and the third time delay.

7. The system of claim 1 further comprising an enable module that enables the solenoid control module to generate the solenoid control signal based on engine oil temperature and system voltage.

8. The system of claim 1 wherein the solenoid control module estimates a first time delay, a second time delay, and a third time delay based on a change in slope of solenoid current.

9. The system of claim 1 wherein the position signal indicates at least one of a current, a magnetic flux, and a position.

10. An engine oil change detection system for an engine, comprising:

a solenoid disposed within an engine oil sump wherein the solenoid includes an armature;

a passage routed to the armature including an orifice to allow fluids to flow through the passage; and a control module that energizes and de-energizes the solenoid, that monitors a position of the armature based on the energizing and the de-energizing of the solenoid, that estimates a delay time based on the position, and that detects an engine oil change event based on the delay time.

11. The system of claim 10 wherein the control module cycles the energizing and the de-energizing of the solenoid when the delay time is less than a time threshold.

12. The system of claim 10 wherein the control module energizes and de-energizes the solenoid based on engine oil temperature.

13. The system of claim 10 wherein the control module energizes and de-energizes the solenoid based on system voltage.

14. The system of claim 10 wherein the control module estimates a first time delay and a second time delay based on an engine run status.

15. The system of claim 14 wherein the control module estimates a third time delay based on the second time delay.

16. The system of claim 15 wherein the control module sets one of a drain status indicator and an oil change status indicator based on the second time delay and the third time delay.

* * * * *